US009444141B2

(12) United States Patent
Asrani et al.

(10) Patent No.: US 9,444,141 B2
(45) Date of Patent: Sep. 13, 2016

(54) ANTENNA SYSTEM FOR A SMART PORTABLE DEVICE USING A CONTINUOUS METAL BAND

(71) Applicant: Google Technology Holdings LLC, Mountain View, CA (US)

(72) Inventors: Vijay L. Asrani, Round Lake, IL (US); Hardik D. Shah, Hoffman Estates, IL (US); Khan Mohammed Z Shams, Lindenhurst, IL (US)

(73) Assignee: Google Technology Holdings LLC, Mountain View, CA (US)

( * ) Notice: Subject to any disclaimer, the term of this patent is extended or adjusted under 35 U.S.C. 154(b) by 333 days.

(21) Appl. No.: 14/056,200

(22) Filed: Oct. 17, 2013

(65) Prior Publication Data

US 2015/0048979 A1 Feb. 19, 2015

Related U.S. Application Data

(60) Provisional application No. 61/867,331, filed on Aug. 19, 2013.

(51) Int. Cl.
*H01Q 1/24* (2006.01)
*H01Q 5/00* (2015.01)
(Continued)

(52) U.S. Cl.
CPC ..... *H01Q 5/0093* (2013.01); *H01Q 1/243* (2013.01); *H01Q 1/521* (2013.01); *H01Q 13/103* (2013.01); *H01Q 21/28* (2013.01)

(58) Field of Classification Search
CPC ..... H01Q 5/0093; H01Q 1/243
See application file for complete search history.

(56) References Cited

U.S. PATENT DOCUMENTS 8,270,914 B2 9/2012 Pascolini et al.
8,275,327 B2 9/2012 Yi et al.
(Continued)

FOREIGN PATENT DOCUMENTS

EP 2 498 336 9/2012
EP 2731194 5/2014

OTHER PUBLICATIONS

Zhong, Jiangwei et al.: "A Novel Multi-band Antenna for Mobile Phone with Metal Frame", Wireless Communications, Networking and Mobile Computing (WICOM), 2012 8th International Conference on, 2012, 10.1109/WiCOM.2012.6478341, all pages.
(Continued)

*Primary Examiner* — Trinh Dinh
(74) *Attorney, Agent, or Firm* — Faegre Baker Daniels LLP

(57) ABSTRACT

A method and portable device provide multi-band, multi-antenna signal communication in a portable device having wireless communication capability. A portable device comprises a single loop multi-feed (SLM) antenna system which includes a continuous conductive ring located along and adjacent to a first device periphery area. The SLM antenna system also comprises multiple communication feeds each respectively coupled to one of multiple transceivers and to the conductive ring. The SLM antenna system includes multiple ground connection points each of which is coupled to a ground plane. Each ground connection point is selectively positioned at a corresponding location on the continuous conductive ring in order to configure, within the SLM antenna system, multiple corresponding antenna elements. The SLM antenna system enables frequency tuning associated with a first antenna element to be performed independently of frequency tuning associated with a second antenna element and supports signal propagation via the multiple antennas using respective frequency bands.

20 Claims, 7 Drawing Sheets

(51) Int. Cl.

| | |
|---|---|
| ***H01Q 1/52*** | (2006.01) |
| ***H01Q 13/10*** | (2006.01) |
| *H01Q 21/28* | (2006.01) |

(56) References Cited

U.S. PATENT DOCUMENTS

2010/0123632 A1 5/2010 Hill et al.
2011/0001673 A1 1/2011 You et al.
2012/0146858 A1 6/2012 Tsai et al.
2012/0229347 A1* 9/2012 Jin ..... H01Q 1/243 343/702
2012/0268328 A1 10/2012 Kim et al.
2013/0135158 A1 5/2013 Faraone et al.
2013/0203364 A1* 8/2013 Darnell ..... H01Q 1/243 455/77
2014/0139380 A1* 5/2014 Ouyang ..... H01Q 7/00 343/702
2015/0171916 A1* 6/2015 Asrani ..... H04B 1/68 455/575.7
2015/0249292 A1* 9/2015 Ouyang ..... H01Q 21/30 343/702
2015/0312058 A1* 10/2015 Black ..... H04L 25/0278 455/77

OTHER PUBLICATIONS

Kumari, Sakshi et al.: "Microstrip Loop Antenna for Wearable Applications", 1st Int'l Conf. on Recent Advances in Information Technology, RAIT-2012, 978-1-4577-0697-4/12/$26.00, all pages, Apr. 12, 2012.
International Search Report and Written Opinion for PCT/US2014/049909, issued Oct. 23, 2014, 13 pgs.

* cited by examiner

500

| BT Avg. Sys. Efficiency (%) | Metal Band |
|---|---|
| Free Space | 19.3 |
| Left Arm | 17 |
| Right Arm | 17 |

502

504

506

FIG. 5

600

| BT Avg. Sys. Efficiency (%) | Metal Band |
|---|---|
| Free Space | 16.7 |
| Left Arm | 14.6 |
| Right Arm | 14.7 |

602

604

606

FIG. 6

ANTENNA SYSTEM FOR A SMART PORTABLE DEVICE USING A CONTINUOUS METAL BAND

BACKGROUND

1. Technical Field

The present disclosure relates in general to multi-antenna systems and in particular to multi-antenna systems in electronic devices.

2. Description of the Related Art

With an ever increasing demand for continuous wireless communication access and for various notification services, some portable devices that are traditionally not constructed as communicating devices, are being designed with integrated wireless communication capability. Some of these portable devices are re-designed as smart devices with limited access to specific types of data. These designs, which provide integrated wireless communication capability, are presented with a number of challenges, including a need to balance cosmetic features with functional features. In addition, designers of these portable devices with integrated wireless communication capability are challenged to satisfy high performance communication requirements. These requirements have to be satisfied despite the presence of components which do not necessarily support the functionality of each other and/or are intended to support un-related features of the portable device.

BRIEF DESCRIPTION OF THE DRAWINGS

The described embodiments are to be read in conjunction with the accompanying drawings, wherein:

FIG. 5 is a table of average system efficiency values for a direct feed Bluetooth (BT) antenna utilized within an SLM antenna system implemented within an example portable device, according to one embodiment;

FIG. 6 is a table of average system efficiency values for a capacitive feed BT antenna utilized within an SLM antenna system implemented within an example portable device.

DETAILED DESCRIPTION

Figure 1:
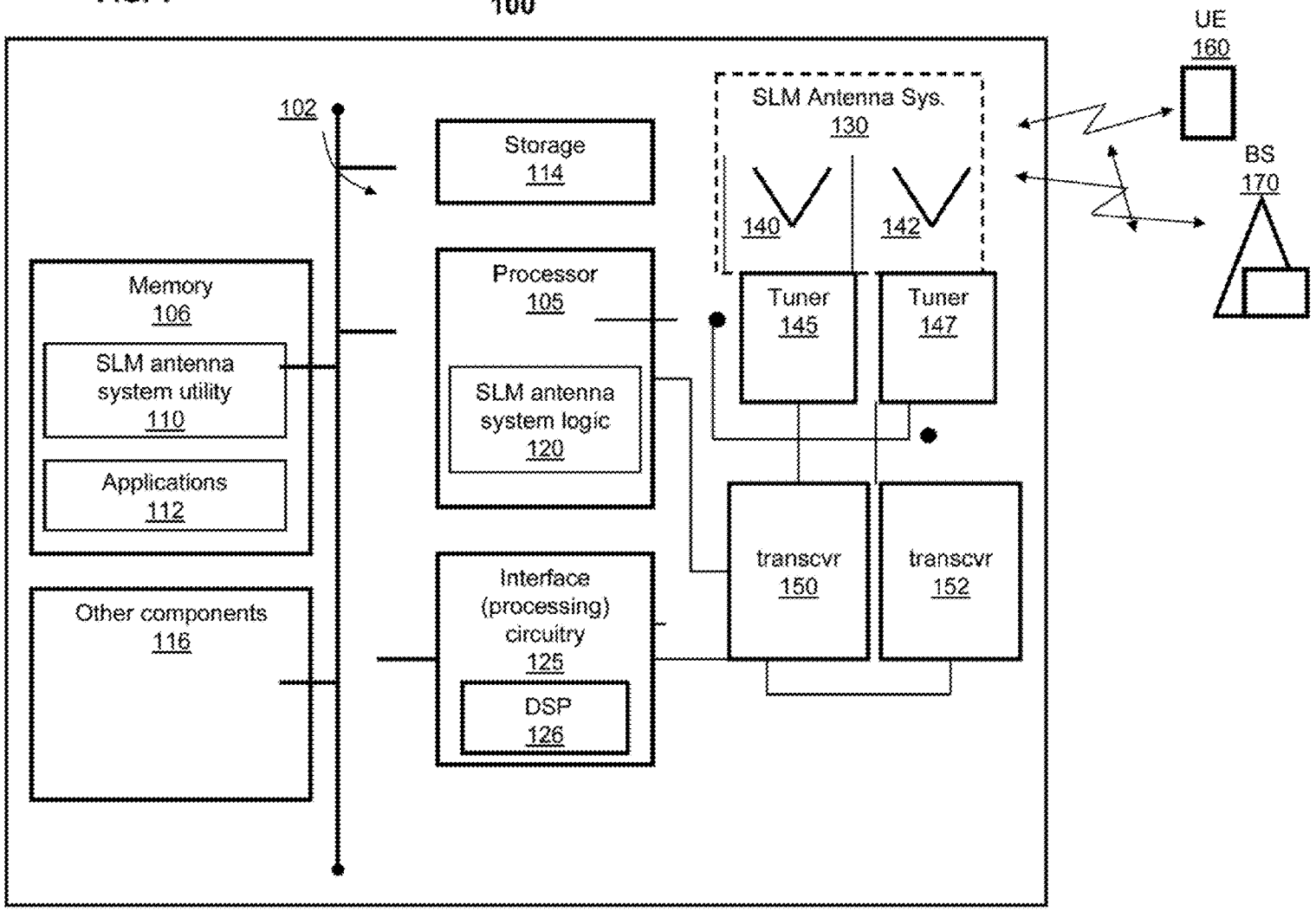
FIG. 1 is a block diagram of an example portable device having wireless communication capability, within which the functional aspects of the described embodiments may be implemented.

The illustrative embodiments provide a method and portable device configured for providing multi-band, multi-antenna signal communication in a portable device having wireless communication capability. The portable device comprises a single loop multi-feed (SLM) antenna system which includes a continuous conductive ring located along and adjacent to a first device periphery area. The SLM antenna system also comprises multiple communication feeds each respectively coupled to one of multiple transceivers and to the conductive ring. The SLM antenna system includes multiple ground connection points each of which is coupled to a ground plane. Each ground connection point is selectively positioned at a corresponding location on the continuous conductive ring in order to configure, within the SLM antenna system, multiple corresponding antenna elements. A corresponding ground connection sub-circuit may be utilized and may include a tunable impedance or a switchable impedance to enable antenna tuning. The SLM antenna system enables frequency tuning associated with a first antenna element to be performed independently of frequency tuning associated with a second antenna element and supports signal propagation via the multiple antennas using respective frequency bands.

In the following detailed description of exemplary embodiments of the disclosure, specific exemplary embodiments in which the various aspects of the disclosure may be practiced are described in sufficient detail to enable those skilled in the art to practice the invention, and it is to be understood that other embodiments may be utilized and that logical, architectural, programmatic, mechanical, electrical and other changes may be made without departing from the spirit or scope of the present disclosure. The following detailed description is, therefore, not to be taken in a limiting sense, and the scope of the present disclosure is defined by the appended claims and equivalents thereof.

Within the descriptions of the different views of the figures, similar elements are provided similar names and reference numerals as those of the previous figure(s). The specific numerals assigned to the elements are provided solely to aid in the description and are not meant to imply any limitations (structural or functional or otherwise) on the described embodiment.

It is understood that the use of specific component, device and/or parameter names, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

As further described below, implementation of the functional features of the disclosure described herein is provided within processing devices and/or structures and can involve use of a combination of hardware, firmware, as well as several software-level constructs (e.g., program code and/or program instructions and/or pseudo-code) that execute to provide a specific utility for the device or a specific functional logic. The presented figures illustrate both hardware components and software and/or logic components.

Those of ordinary skill in the art will appreciate that the hardware components and basic configurations depicted in the figures may vary. The illustrative components are not intended to be exhaustive, but rather are representative to highlight essential components that are utilized to implement aspects of the described embodiments. For example, other devices/components may be used in addition to or in place of the hardware and/or firmware depicted. The depicted example is not meant to imply architectural or other limitations with respect to the presently described embodiments and/or the general invention.

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein.

With specific reference now to FIG. 1, there is depicted a block diagram of an example portable device 100, within which the functional aspects of the described embodiments may be implemented. Portable device 100 includes wireless communication technology and represents a device that is adapted to transmit and receive electromagnetic signals over an air interface via uplink and/or downlink channels between portable device 100 and at least one of (a) a wireless user equipment (UE) (e.g., UE 160), (b) a wireless base station 170 and (c) a satellite based communication system (not shown). In one embodiment, portable device 100 is configured to communicate with UE 160 using Bluetooth (BT) technology and/or to receive signals from a Global Positioning System (GPS) transmitter. In one or more embodiments, the portable device 100 can be a mobile cellular phone, smartphone, laptop, netbook or tablet computing device, or other type of communication device. Furthermore, portable device 100 can be an electronic device enhanced with wireless communication capability. For example, a smart watch is a portable electronic device for time-keeping, but which has been enhanced with wireless communication technology to support wireless communication. Other examples of portable device 100 can include devices utilized as part of security tracking mechanisms. For example, portable device 100 can be a smart electronic bracelet worn by a child. In addition, portable device 100 can include smart electronic bracelets or collars worn by pets. Portable device 100 comprises processor 105 and interface circuitry 125, which are connected to memory component 106 via signal bus 102. Interface circuitry 125 includes digital signal processor (DSP) 126. Portable device 100 also comprises storage 114. In addition, portable device 100 comprises other device components 116 which are associated with other functions and capabilities of portable device 100. For example, in a smart watch, which is an example portable device, these other device components 116 include components associated with timekeeping.

Portable device 100 also includes multiple transceivers, including first transceiver 150 and second transceiver 152, for sending and receiving communication signals. In at least some embodiments, the sending and receiving of communication signals occur wirelessly and are facilitated by multiple antennas, including first antenna element 140 and second antenna element 142, which are communicatively coupled to the multiple transceivers (150 and 152), respectively. Also included within portable device 100 are multiple antenna/communication feeds (or simply "feeds") (shown and described below). In one embodiment, the multiple antennas and the multiple communication feeds collectively represent single loop multi-feed (SLM) antenna system 130. The number of antennas (i.e., antenna elements) can vary from device to device, ranging from a single antenna to two or more antennas, and the presentation within portable device 100 of two antenna elements 140 and 142 is merely for illustration. In one embodiment, portable device 100 comprises first antenna tuner 145 communicatively coupled to first antenna element 140 and second antenna tuner 147 communicatively coupled to second antenna element 142. The processor 105 controls the tuners 145 and 147 via logic signal lines, according to the frequency of operation.

In one embodiment, portable device 100 is able to wirelessly communicate to base-station or access node 170 via one or more antennas (e.g., antenna 140). Base station or access node 170 can be any one of a number of different types of network stations and/or antennas associated with the infrastructure of the wireless network and configured to support uplink and downlink communication via one or more of the wireless communication protocols, as known by those skilled in the art.

In addition to the above described hardware components of portable device 100, various features of the invention may be completed or supported via software or firmware code and/or logic stored within at least one of memory 106 and a local memory of a corresponding transceiver, and respectively executed by DSP 126 or processor 105, or a local processor of the transceiver. Thus, for example, included within system memory 106 and/or local memory associated with the multiple transceivers can be a number of software, firmware, logic components, or modules, including single loop multi-feed (SLM) antenna system utility 110 and applications 112.

The various components within portable device 100 can be electrically and/or communicatively coupled together as illustrated in FIG. 1. As utilized herein, the term "communicatively coupled" means that information signals are transmissible through various interconnections between the components. The interconnections between the components can be direct interconnections that include conductive transmission media, or may be indirect interconnections that include one or more intermediate electrical components. Although certain direct interconnections are illustrated in FIG. 1, it is to be understood that more, fewer or different interconnections may be present in other embodiments. The structural makeup of the SLM antenna system and the connectivity of associated components are described in greater detail in FIG. 2.

Figure 2:
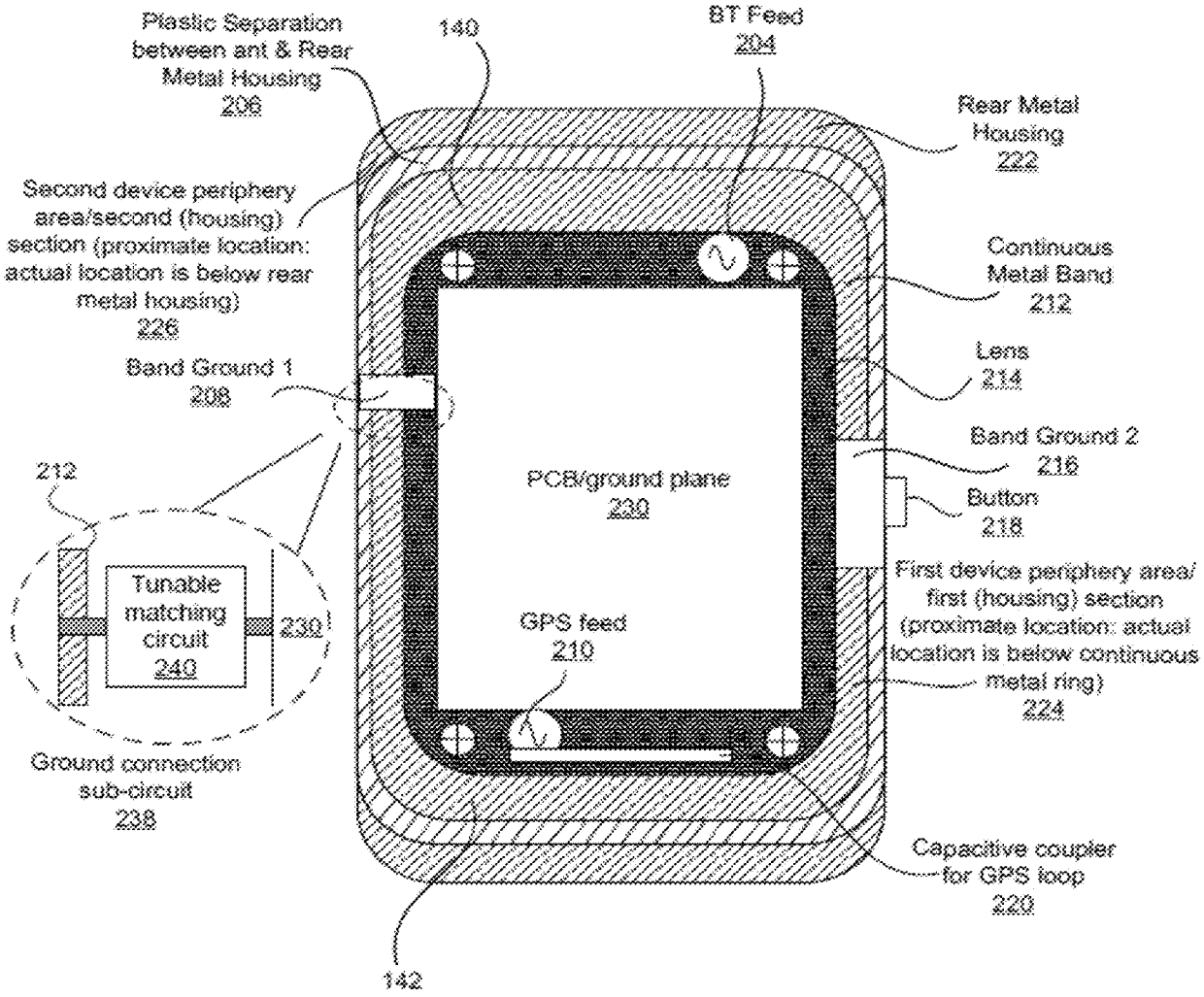
FIG. 2 provides a block diagram representation of a portable device which provides multi-band, multi-antenna wireless communication capability by utilizing a single continuous conductive metal loop to provide multiple antennas, according to one embodiment.

With specific reference now to FIG. 2, there is depicted a block diagram representation of a portable device which provides multi-band, multi-antenna wireless communication capability by utilizing a single continuous conductive metal ring or band to provide multiple antennas, according to one embodiment. The conductive metal ring can also be a front housing to provide structural support to the portable device. Portable device 100 comprises multiple transceivers (not shown in FIG. 2) including first transceiver 150 (FIG. 1) and second transceiver 152 (FIG. 1), each of which are capable of propagating communication signals. Portable device 100 comprises a single loop multi-feed (SLM) antenna system (not explicitly shown in FIG. 2) further comprising a single continuous metal band/conductive ring 212 that surrounds and is adjacent to a first device periphery area 224 of portable device 100. This first device periphery area 224 is a first section of a device periphery area which can be represented by a protective, plastic internal housing (e.g., plastic internal housing 404, FIG. 4) for internal components of portable device 100. In at least one embodiment, the first section is occluded from view by being surrounded and covered by conductive ring 212. In another embodiment, single continuous conductive ring 212 represents the first device periphery area of portable device 100. The SLM antenna system (e.g., SLM 130) also comprises multiple communication feeds each respectively coupled to one of the multiple transceivers, and including a first feed (e.g., Bluetooth (BT) antenna feed 204) and a second feed (GPS antenna feed 210). In one embodiment, portable device 100 comprises capacitive coupler 220 to provide capacitive feed capability for GPS antenna feed 210. The multiple communication feeds are communicatively coupled to continuous conductive ring 212. In one embodiment, each of the multiple feeds are connected to a tunable matching circuit to enable multi-band operation. For the capacitive feed system, a direct contact feed point between the continuous conductive band 212 and the PCB 230 is not required. The SLM antenna system includes a first ground connection point represented by "Band Ground 1" 208 and a second ground connection point represented by "Band Ground 2" 216, both of which are coupled to printed circuit board/ground plane 230. The ground connection points are specific locations on conductive ring 212 that are electrically coupled to a ground terminal or plane via either a direct connection lead or a tunable matching circuit 240. Tunable matching circuit 240 provides optimum impedance for the frequency of operation for a corresponding antenna element. In one implementation, ground plane 230 is represented by a ground terminal coupled to the ground connection points and located on one of a printed circuit board (PCB) and a chassis of portable device 100. As described herein, a ground connection point with either a direct ground lead or a tunable matching circuit coupled between continuous conductive ring 212 and ground plane 230 constitute a ground connection sub-circuit (e.g., ground connection sub-circuit 238). Thus, "Band ground" can be more appropriately used to represent a ground connection sub-circuit. Each of first ground connection point 208 and second ground connection point 216 are selectively positioned at a corresponding location on continuous conductive ring 212 in order to configure, within the SLM antenna system, multiple corresponding antenna elements including a first antenna element 140 and a second antenna element 142. In FIG. 2, first antenna element 140 represents a first arc or section of continuous conductive ring 212, which first/top arc is located between "Band Ground 1" 208 and "Band Ground 2" 216. Second antenna element 142 represents a second/bottom arc or section of continuous conductive ring 212, which second arc is also located between "Band Ground 1" 208 and "Band Ground 2" 216 and below and opposed to the first arc providing first antenna element 140. The SLM antenna system is capable of propagating communication signals via respective antenna elements (140, 142) using multiple frequency bands including a first frequency band and a second frequency band. Each antenna element resonates at a respective pre-specified frequency centered on a corresponding frequency band. The ground connection points (208, 216) are selectively positioned to provide a specified level of antenna radiation efficiency corresponding to a particular frequency band.

In one embodiment, portable device 100 also comprises rear metal/conductive housing 222 and insulator 206, which can be a plastic component. Insulator 206 physically and electrically separates continuous conductive ring 212 from rear metal/conductive housing 222. Conductive device rear housing 222 is adjacent to and surrounds a second device periphery area 226 that does not intersect with the first device periphery area 224. In one embodiment, conductive device housing 222 represents the second device periphery area of portable device 100. In one embodiment, the conductive housing 222 is coupled to the ground plane of the portable device 100. The insulator 206 can be eliminated if the rear housing 222 is made of other non conductive material (e.g., plastic). Also illustrated within portable device 100 are protective display lens 214 and functional button 218.

In an example embodiment, in which the SLM antenna system comprises two feeds and two ground connection points, as illustrated in FIG. 2, the first and second ground connection points 208 and 216 electrically isolates the second antenna feed 210 from the first antenna element 140. In addition, the first and second ground connection points 208 and 216 electrically isolate the first antenna feed 204 from the second antenna element 142. As a result, the isolation provided by the first and second ground connection points (208, 216) collectively enable frequency tuning associated with the first antenna element 140 to be performed independently of frequency tuning associated with the second antenna element 142. In particular, electronic circuit adjustments made at a first tuner corresponding to a first antenna feed presents no significant change in the input impedance of the second antenna feed corresponding to a second antenna element because of a presence of a path to ground via the Band Ground connection points 208 and 216.

In one embodiment, first antenna element 140 is a Bluetooth (BT) antenna element and the first ground connection point 208 couples the BT antenna element (e.g., antenna element 140) to ground. In a related embodiment, second antenna element 142 is a global positioning system (GPS) antenna element and the second ground connection point 216 couples the GPS antenna element to ground. In portable device 100, each of the communication feeds is one of a direct feed and a capacitive feed. In one or more embodiments, a capacitive coupler is coupled to the second feed to enable propagation of GPS signals via the GPS antenna element (e.g., second antenna element 142) using a capacitive feed technology. In one implementation, portable device 100 comprises an internal antenna (e.g., internal antenna element 328 of FIG. 3) which is utilized as the capacitive coupler.

In one or more embodiments, portable device 100 is a smart device that communicates with a second wireless communication device (e.g., UE 160) while portable device 100 operates as a functional extension of the second wireless communication device by at least one of (a) providing/receiving notifications and (b) receiving emails, from the second wireless communication device. The UE 160 is communicatively coupled to BS 170.

Figure 3:
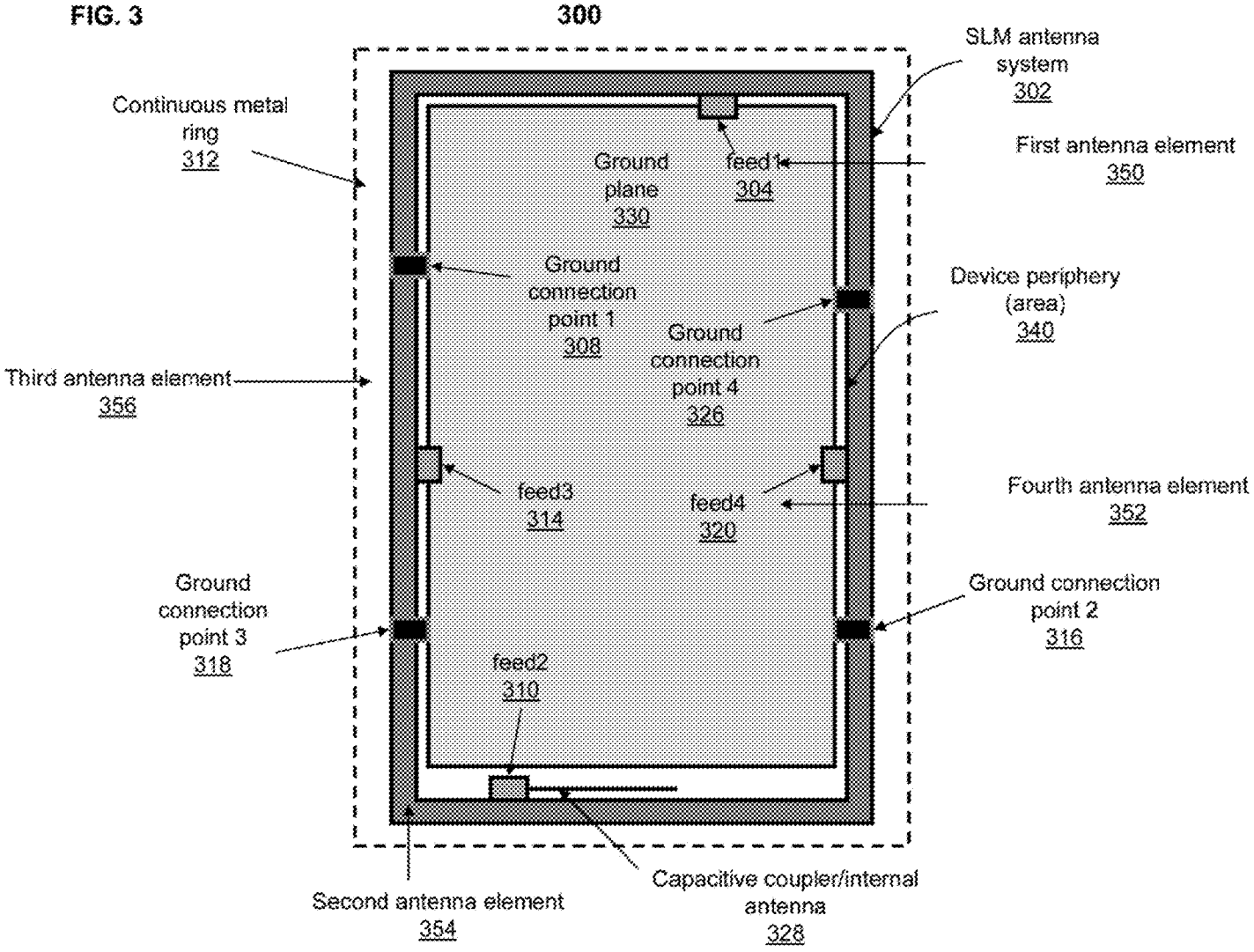
FIG. 3 is a block diagram representation of a single loop multi-feed (SLM) antenna system than can be utilized within a portable device having wireless communication capability, according to one embodiment.

FIG. 3 is a block diagram representation of a single loop multi-feed (SLM) antenna system than can be utilized within a portable device having wireless communication capability, according to one embodiment. Portable device 300 comprises multiple transceivers (not shown), each of which are capable of propagating communication signals. Portable device 300 comprises single loop multi-feed (SLM) antenna system 302. SLM antenna system 302 comprises a continuous (metal) conductive ring 312 that is adjacent to and surrounds a first device periphery area (similar to first device periphery area 224 of FIG. 2) of portable device 300. Continuous conductive ring 312 comprises four sections illustrated as first antenna element 350, second antenna element 354, third antenna element 356 and fourth antenna element 352, respectively. SLM antenna system 302 also comprises multiple communication feeds each respectively coupled to one of the multiple transceivers, and including a first feed 304, a second feed 310, a third feed 314 and a fourth feed 320. The multiple communication feeds are respectively coupled to the multiple antenna elements of continuous conductive ring 312.

SLM antenna system 302 includes a first ground connection point 308, a second ground connection point 316, third ground connection point 318 and a fourth ground connection point 326, each of which is coupled to printed circuit board/ground plane 330 via either a direct lead or a tunable matching circuit (i.e., similar to tunable matching circuit 240 of FIG. 2). The ground connection points are specific locations on conductive ring 312 that are electrically coupled to a ground terminal or plane via either a direct connection lead or a tunable matching circuit. Each of first ground connection point 308, a second ground connection point 316, third ground connection point 318 and a fourth ground connection point 326 are selectively positioned at a corresponding location on continuous conductive ring 312 in order to configure, within the SLM antenna system, four antenna elements corresponding to first feed 304, second feed 310, third feed 314 and fourth feed 320.

As illustrated within SLM antenna system 302, first antenna element 350 represents a first section of continuous conductive ring 312 and is located between first ground connection point 308 and fourth ground connection point 326. Second antenna element 354 represents a second section of continuous conductive ring 312 and is located between second ground connection point 316 and third ground connection point 318. Third antenna element 356 represents a third section of continuous conductive ring 312 and is located between first ground connection point 308 and third ground connection point 318. Fourth antenna element 352 represents a fourth section of continuous conductive ring 312 and is located between second ground connection point 316 and fourth ground connection point 326. The locations of the ground connection points on continuous conductive ring 312 are selectively determined to create various antenna elements having specific shapes from respective sections of continuous conductive ring 312. Each of the multiple sections corresponding to a respective antenna element can be characterized as having a corresponding degree of curvature or bending based on a shape of continuous conductive ring 312 and the selected placement of adjacent ground connection points. As a result, an antenna element can be described as being one of (a) substantially linear shaped, (b) arc shaped, (c) semi-circular shaped and (c) partially linear and partially circular or arc shaped, among others.

In an example embodiment, in which the SLM antenna system comprises four feeds and four ground connection points, which are placed in relative positions as illustrated in FIG. 3, first and fourth ground connection points 308 and 326 isolate the first antenna feed 304 from the other three antenna feeds 314, 320 and 310. In addition, the second and third ground connections point 316 and 318 isolates the second antenna feed 310 from the other three antenna feeds 304, 314 and 320. The first and third ground connection points 308 and 318 isolates the third antenna feed 314 from the other three antenna feeds 304, 310 and 320. The second and fourth ground connection points 316 and 326 isolates the fourth antenna feed 320 from the other antenna feeds 304, 310 and 314. As a result, the isolation provided by the multiple ground connection points (e.g., 308, 316, 318 and 326) collectively enable frequency tuning associated with each selected antenna element to be performed independently of frequency tuning associated with any of the other antenna elements. These other antennas include one or more adjacent antenna elements. For example, frequency tuning associated with first antenna element 350 can be performed independently of frequency tuning respectively associated with second antenna element 354 and a pair of adjacent antenna elements comprising third antenna element 356 and fourth antenna element 352. This independent tuning can occur because electronic circuit adjustments made at a first tuner corresponding to a first antenna feed 304 presents no significant change in the input impedance of the second antenna feed 310 corresponding to a second antenna element 354 because of a presence of a path(s) to ground via the Ground connection points (e.g., 308 and 326).

More generally, the first antenna element 350 is adjacent to a first pair of ground connection points which include the first and the fourth ground connection points (308 and 326). The second antenna element 354 is adjacent to a second pair of ground connection points which include the second and third ground connection points (316 and 318). The first pair of ground connection points isolates the first feed 304, corresponding to the first antenna element 350, from any other antenna element besides the first antenna element 350. The second pair of ground connection points isolates the second feed 310, corresponding to the second antenna element, from any other antenna element besides the second antenna element 354.

Isolation enables frequency tuning associated with the first antenna element to be performed independently of frequency tuning associated with any other antenna element from among the multiple antenna elements including the second antenna element. Furthermore, isolation enables frequency tuning associated with the second antenna element to be performed independently of frequency tuning associated with any other antenna element from among the multiple antenna elements including the first antenna element.

Although four communication feeds and four corresponding ground connection points are illustrated within SLM antenna system 302, the number of feeds and/or corresponding ground connection points is not limited to a specific number. SLM antenna system 302 is capable of propagating communication signals via multiple antenna elements using multiple frequency bands, including a first frequency band, a second frequency band, a third frequency band and a fourth frequency band, respectively.

Figure 4:
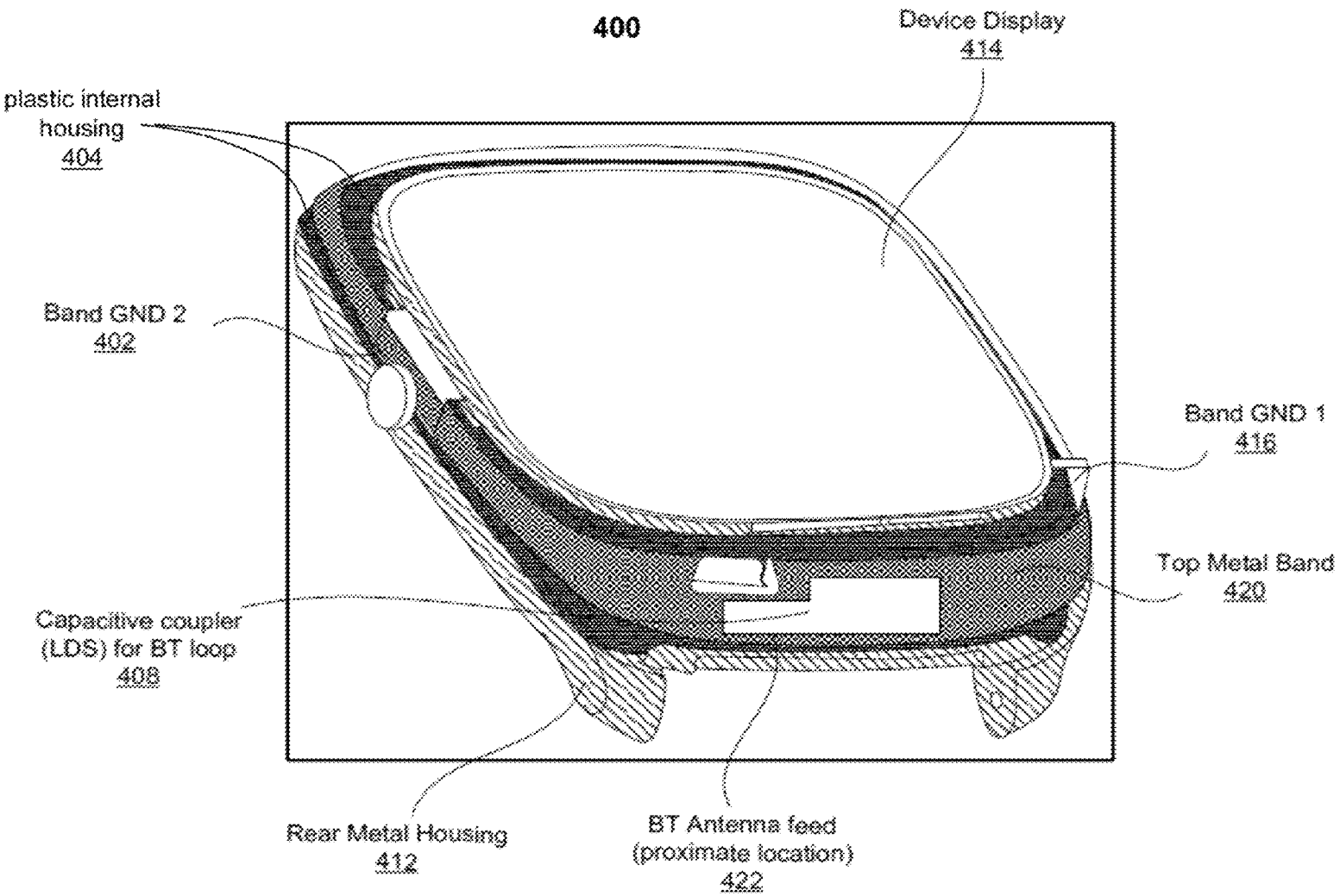
FIG. 4 illustrates a smart watch as an example portable device which utilizes the SLM antenna system, according to one embodiment.

FIG. 4 illustrates a smart watch as an example portable device which utilizes the SLM antenna system, according to one embodiment. In the example of FIG. 4, portable device 100 is a smart watch 400 which comprises a single loop multi-feed (SLM) antenna system (i.e., similar to SLM antenna system 130). Smart watch 400 comprises a continuous conductive ring illustrated as top metal band 420. Continuous conductive ring 420 is located adjacent to and surrounding a first device periphery area 224 of smart watch 400. Illustrated within smart watch 400 is BT antenna feed (proximate location) 422. Smart watch 400 includes a first ground connection point illustrated as Band Ground 2 402 and a second ground connection point illustrated as Band Ground 1 416. As illustrated, smart watch 400 comprises capacitive coupler 408 to provide capacitive feed capability for BT antenna feed 422. Smart watch 400 also comprises rear metal/conductive housing 412 which is electrically separated from top metal band 420 except at the two Band Ground contacts or connection points 402 and 416. Also illustrated within smart watch 400 is device display 414. The BT capacitive coupler can be placed at a location on the plastic internal housing 404 using Laser Direct Structuring (LDS) or similar technology. Alternatively, a flexible substrate can be used to implement the BT capacitive coupler.

Smart watch 400 is a computerized wristwatch that can communicate with a second wireless communication device (e.g., UE 160) while smart watch 400 operates as a functional extension of the second wireless communication device by providing associated signal transmission and reception capabilities, which can be associated with at least one of (a) receiving notifications, (b) propagation of position or location based signals, (c) propagating sensor data and (d) receiving emails.

In one embodiment, smart watch 400 is able to run mobile applications and can include complete mobile phone capability. In one or more embodiments, smart phone 400 functions as a mobile media player and can provide playback of frequency modulation (FM) radio and audio and video files. In one implementation, smart phone 400 can provide sound to a user via a Bluetooth headset.

In one or more related embodiments, smart watch 400 includes features associated with use or operation and/or include components of any one of a camera, an accelerometer, a thermometer, an altimeter, a barometer, a compass, a chronograph, a calculator and a touch screen. In addition, smart watch 400 can provide features and/or includes components associated with any one of GPS navigation, map display, graphical display, a speaker, a scheduler, Secure Digital (SD) cards that are recognizable as mass storage devices, and a rechargeable battery. In various embodiments, smart watch 400 can communicate with a wireless headset, a heads-up display, an insulin pump, a microphone, a modem, or other electronic devices.

Smart watch 400 can also provide "sport watch" functionality. Sport watch functionality can be provided through the use of GPS signals and by enabling the measurement of distances and corresponding intervals of time during various sports training exercises such as diving and sprint or long distance racing. As a result, in one embodiment, smart watch 400 can provide a functionality of a speed display, a GPS tracking unit and a dive computer, and can perform route tracking and speed tracking.

In one or more embodiments, smart watch 400 can be equipped to provide heart rate monitor compatibility, cadence sensor compatibility, and compatibility with "sport transitions" tracking. Sports transition tracking involves monitoring the change or "transition" from one sport to another as found in a triathlon.

Smart watch 400 may collect information from internal or external sensors which may represent other portable devices. Smart watch 400 may control, or retrieve data from, other instruments or computers. Smart watch 400 may support wireless technologies like Bluetooth, Wi-Fi, and GPS. However, smart watch 400 operating as a "wristwatch computer" may serve as a front end for a remote system to which smart watch 400 is wirelessly connected.

FIG. 5 is a table of average system efficiency values for a direct feed BT antenna utilized within an SLM antenna system that is implemented within an example portable device, according to one embodiment. Table 500 provides BT antenna efficiency values that correspond to a portable device that can be worn on a user's right arm or left arm. For example, the portable device is a smart watch (e.g., smart watch 400). As a further example, the portable device can be a smart electronic bracelet that can be worn or an arm or a leg or a smart electronic collar that can be worn around the neck. In addition, the portable device may be a smart electronic sensor that can be worn on a corresponding part of the body. As a result, other tables of antenna efficiency values can be generated, which tables can provide values associated with use cases in which the portable device is worn on different parts of the body including around the leg or around the neck. Table 500 comprises average BT antenna efficiency values corresponding to the SLM antenna system. The first column of table 500 identifies various use cases of portable device 100, which use cases indicate an orientation of portable device 100 and/or how portable device 100 is carried. The second column identifies average BT antenna efficiency values associated with the SLM antenna system corresponding to the various use cases identified within the first column.

Table 500 further comprises first row 502, second row 504 and third row 506. First row 502 indicates that for a "free-space" use case (i.e., when portable device 100 is not being worn), the average antenna system efficiency for a BT antenna utilized in an SLM antenna system is 19.3%.

Second row 504 indicates that for a "left-arm" use case (i.e., when portable device 100 is being worn on a user's left arm), the average antenna system efficiency for a BT antenna utilized in an SLM antenna system is 17%. Third row 506 indicates that for a "right-arm" use case (i.e., when portable device 100 is being worn on a user's right arm), the average antenna system efficiency for a BT antenna utilized in an SLM antenna system is 17%.

As table 500 indicates, for a direct feed BT antenna, the average antenna efficiency values (column 2) for the more common use cases in which portable device 100 is worn on the left-arm or right arm, are similar to the values for the free space use case. This similarity in values indicates that the radiated energy dissipation in the user's arm is negligible. In addition to providing acceptable antenna system efficiency performance, portable device 100, which includes the SLM antenna system, is specifically designed to limit RF energy exposure of the user's arm to a negligible or low absorption level. This low RF energy absorption satisfies the Specific Absorption Rate (SAR) limits that are established by the Federal Communications Commission (FCC).

FIG. 6 is a table of average system efficiency values for a capacitive feed BT antenna utilized within an SLM antenna system that is implemented within an example portable device, according to one embodiment. Table 600 provides BT antenna efficiency values that correspond to a portable device that can be worn on a user's right arm or left arm. For example, the portable device is a smart watch (e.g., smart watch 400). Table 600 comprises average BT antenna efficiency values corresponding to the SLM antenna system. The first column of table 600 identifies various use cases of portable device 100, which use cases indicate an orientation of portable device 100 and/or how portable device 100 is carried. The second column identifies average BT antenna efficiency values associated with the SLM antenna system corresponding to the various use cases identified within the first column. Table 600 further comprises first row 602, second row 604 and third row 606. First row 602 indicates that for a "free-space" use case (i.e., when portable device 100 is not being worn), the average antenna system efficiency for a BT antenna utilized in an SLM antenna system is 16.7%.

Second row 604 indicates that for a "left-arm" use case (i.e., when portable device 100 is being worn on a user's left arm), the average antenna system efficiency for a BT antenna utilized in an SLM antenna system is 14.6%. Third row 606 indicates that for a "right-arm" use case (i.e., when portable device 100 is being worn on a user's right arm), the average antenna system efficiency for a BT antenna utilized in an SLM antenna system is 14.7%.

As table 600 indicates, for a capacitive feed BT antenna, average antenna efficiency values (column 2) for the more common use cases in which portable device 100 is worn on the left-arm or right arm, are similar to the values for the free space use case. This similarity in values indicates that the radiated energy dissipation in the user's arm is negligible. In addition to providing acceptable antenna system efficiency performance, portable device 100, which is designed with the SLM antenna system, exposes the user's arm to negligible or low absorption of RF energy. This low RF energy absorption satisfies the Specific Absorption Rate (SAR) limits that are established by the Federal Communications Commission (FCC). From the results provided in tables 500 and 600, one can conclude that for use cases in which portable device 100 is worn on the left arm or right arm, both the direct feed and capacitive feed systems provide acceptable antenna system efficiency performance. It is reasonable to expect that acceptable antenna system efficiency performance can be achieved for portable devices that are designed to be worn on other body parts including on a right leg, a left leg or on or around the neck, for example.

Figure 7:
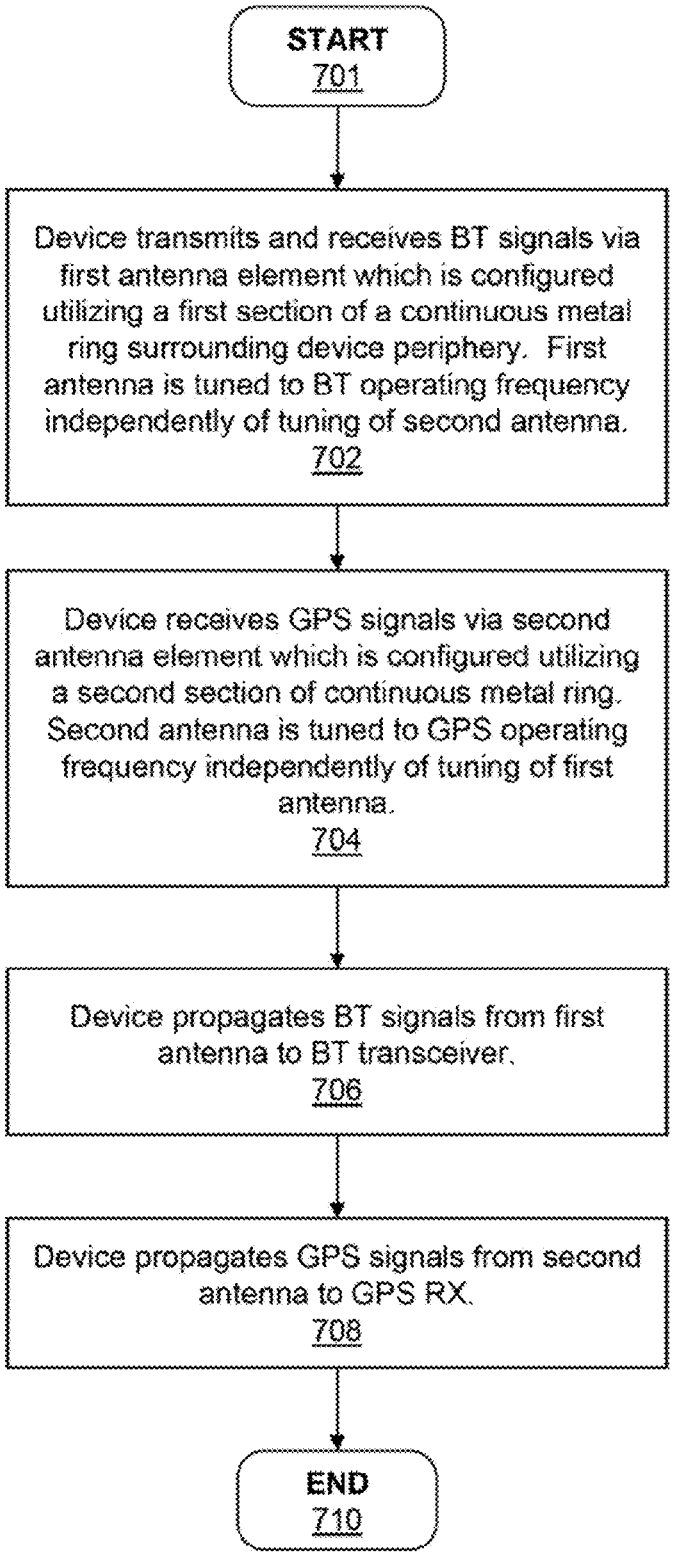
FIG. 7 is a flow chart illustrating one method for propagating communication signals via multiple bands and multiple antennas using a continuous conductive loop, according to one embodiment.

FIG. 7 is a flow chart illustrating an embodiment of the method by which the above processes of the illustrative embodiments can be implemented. Specifically, FIG. 7 illustrates a method for propagating communication signals via multiple bands and multiple antennas using a continuous conductive loop. Although the method illustrated by FIG. 7 may be described with reference to components and functionality illustrated by and described in reference to FIGS. 1-6, it should be understood that this is merely for convenience and alternative components and/or configurations thereof can be employed when implementing the method. Certain portions of the methods may be completed by SLM antenna system utility 110 executing on one or more processors (FIG. 1). The executed processes then control specific operations of or on wireless portable device 100. For simplicity in describing the method, all method processes are described from the perspective of portable device 100.

The method of FIG. 7 begins at initiator block 701 and proceeds to block 702 at which portable device 100 transmits and receives BT signals via first antenna element 140 which is configured utilizing a first section of continuous metal ring 212 located adjacent to and surrounding a device periphery of portable device 100. First antenna element 140 is tuned to a BT operating frequency independently of frequency tuning associated with second antenna element 142. At block 704, portable device 100 receives GPS signals via second antenna element which is configured utilizing a second section of continuous metal ring 212. Second antenna element 142 is tuned to a GPS operating frequency independently of frequency tuning associated with first antenna element 140. At block 706, portable device 100 propagates BT signals from first antenna element 140 to a BT transceiver (e.g., transceiver 150). At block 708, portable device 100 propagates GPS signals from second antenna element 142 to a GPS receiver. The process ends at block 710.

The flowchart and block diagrams in the various figures presented and described herein illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Thus, while the method processes are described and illustrated in a particular sequence, use of a specific sequence of processes is not meant to imply any limitations on the disclosure. Changes may be made with regards to the sequence of processes without departing from the spirit or scope of the present disclosure. Use of a particular sequence is therefore, not to be taken in a limiting sense, and the scope of the present disclosure extends to the appended claims and equivalents thereof.

In some implementations, certain processes of the methods are combined, performed simultaneously or in a different order, or perhaps omitted, without deviating from the spirit and scope of the disclosure. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A portable device having wireless communication capability, the device comprising:

multiple transceivers capable of propagating respective communication signals;

multiple communication feeds including a first communication feed and a second communication feed, each respectively coupled to one of the multiple transceivers; and a single loop multi-feed (SLM) antenna system comprising:

a continuous conductive ring coupled to the multiple communication feeds and located along and adjacent to a first device periphery area of the portable device, and which is capable of propagating communication signals using multiple frequency bands including a first frequency band and a second frequency band; and a first pair of ground connection points including a first ground connection point and a second pair of ground connection points including a second ground connection point each selectively positioned at corresponding locations on the continuous conductive ring in order to configure multiple corresponding antenna elements including a first antenna element and a second antenna element, which each resonate at pre-specified frequencies centered on the first and second frequency bands, respectively, wherein the first communication feed is configured to couple one of the multiple transceivers to the continuous conductive ring between the first pair of ground connection points, and the second communication feed is configured to couple at least another one of the multiple transceivers to the continuous conductive ring between the second pair of ground connection points.

2. The portable device of claim 1, wherein:

the first and second ground connection points are selectively positioned to provide antenna radiation efficiency corresponding to a particular frequency band.

3. The portable device of claim 1, wherein:

the first antenna element is adjacent to the first pair of ground connection points;

the second antenna element is adjacent to the second pair of ground connection points;

the first pair of ground connection points isolate the first communication feed, corresponding to the first antenna element, from any other antenna element from among the multiple antenna elements;

the second pair of ground connection points isolate the second communication feed, corresponding to the second antenna element, from any other antenna element from among the multiple antenna elements;

wherein isolation enables: frequency tuning associated with the first antenna element to be performed independently of frequency tuning associated with any other antenna element from among the multiple antenna elements which include the second antenna element; and frequency tuning associated with the second antenna element to be performed independently of frequency tuning associated with any other antenna element from among the multiple antenna elements which include the first antenna element.

4. The portable device of claim 1, further comprising:

multiple ground connection sub-circuits corresponding to the multiple ground connection points;

a ground terminal electrically coupled to each ground connection point and located on one of a printed circuit board (PCB) and a chassis of the portable device;

wherein at least one of the multiple ground connection sub-circuits provide a path to the ground terminal.

5. The portable device of claim 4, wherein at least one of the ground connection sub-circuits comprises:

a tunable impedance coupled between a corresponding ground connection point and the ground terminal to enable a respective antenna tuning.

6. The portable device of claim 1, wherein:

the first antenna element is a Bluetooth (BT) antenna element and the first ground connection point couples the BT antenna element to ground; and the second antenna element is a global positioning system (GPS) antenna element and the second ground connection point couples the GPS antenna element to ground.

7. The portable device of claim 6, further comprising:

a capacitive coupler coupled to the second communication feed to enable propagation of GPS signals via the GPS antenna element using a capacitive feed technology;

wherein the second ground connection point which corresponds to the second communication feed is connected to the ground plane.

8. The portable device of claim 7, wherein the capacitive coupler is an internal antenna.

9. The portable device of claim 1, further comprising:

a conductive device housing which is located adjacent to and surrounding a second device periphery area that does not intersect with the first device periphery area; and an insulator placed in a position between the continuous conductive ring and the conductive device housing to provide electrical separation between the continuous conductive ring and the conductive device housing.

10. The portable device of claim 1, wherein:

the portable device is a smart device that communicates with a second wireless communication device while the portable device operates as a functional extension of the second wireless communication device by providing associated signal transmission and reception capabilities associated with a group comprising (a) receiving notifications, (b) propagation of location based signals, (c) propagating sensor data and (d) receiving emails.

11. The portable device of claim 1, wherein:

each of the communication feeds is one of a direct feed and a capacitive feed.

12. In a portable device, a method comprising:

propagating multiple communication signals via multiple transceivers using multiple frequency bands via a single loop multi-feed (SLM) antenna system having a single, continuous conductive ring which is separated from other conductive components of the portable device, wherein the SLM antenna system is located along and adjacent to a first device periphery area of the portable device and includes a first pair of ground connection points including a first ground connection point and a second pair of ground connection points including a second ground connection point each selectively positioned at corresponding locations on the continuous conductive ring in order to configure multiple corresponding antenna elements including a first antenna element and a second antenna element, which each resonate at pre-specified frequencies centered on first and second frequency bands, respectively, wherein a first communication feed of the portable device is configured to couple one of the multiple transceivers to the continuous conductive ring between the first pair of ground connection points, and a second communication feed of the portable device is configured to couple at least another one of the multiple transceivers to the continuous conductive ring between the second pair of ground connection points.

13. The method of claim 12, wherein:

the first and second ground connection points are selectively positioned to provide antenna radiation efficiency corresponding to a particular frequency band.

14. The method of claim 12, wherein:

the first antenna element is adjacent to the first pair of ground connection points;

the second antenna element is adjacent to the second pair of ground connection points;

the first pair of ground connection points isolate the first communication feed, corresponding to the first antenna element, from any other antenna element from among the multiple antenna elements;

the second pair of ground connection points isolate the second communication feed, corresponding to the second antenna element, from any other antenna element from among the multiple antenna elements;

wherein isolation enables: frequency tuning associated with the first antenna element to be performed independently of frequency tuning associated with any other antenna element from among the multiple antenna elements which include the second antenna element; and frequency tuning associated with the second antenna element to be performed independently of frequency tuning associated with any other antenna element from among the multiple antenna elements which include the first antenna element.

15. A single loop multi-feed (SLM) antenna system that can be utilized within a device having wireless communication capability, the SLM antenna system comprising:

a continuous conductive ring coupled to a first communication feed and a second communication feed, which can be placed adjacent to and surrounding a periphery area of the device in which the SLM antenna system is utilized, and which is separated from other conductive components of the device, wherein the SLM antenna system is capable of propagating communication signals using multiple frequency bands including a first frequency band and a second frequency band; and a first pair of ground connection points including a first ground connection point and a second pair of ground connection points including a second ground connection point each selectively positioned at corresponding locations on the continuous conductive ring in order to configure multiple corresponding antenna elements including a first antenna element and a second antenna element, which each resonate at pre-specified frequencies centered on first and second frequency bands, respectively, wherein the first communication feed is configured to couple a transceiver of the device having wireless communication capability to the continuous conductive ring between the first pair of ground connection points, and the second communication feed is configured to couple another transceiver of the device having wireless communication capability to the continuous conductive ring between the second pair of ground connection points.

16. The SLM antenna system of claim 15, wherein:

the first and second ground connection points are selectively positioned to provide antenna radiation efficiency corresponding to a particular frequency band.

17. The SLM antenna system of claim 15, wherein:

the first antenna element is adjacent to the first pair of ground connection points;

the second antenna element is adjacent to the second pair of ground connection points;

the first pair of ground connection points isolate the first communication feed, corresponding to the first antenna element, from any other antenna element from among the multiple antenna elements;

the second pair of ground connection points isolate the second communication feed, corresponding to the second antenna element, from any other antenna element from among the multiple antenna elements;

wherein isolation enables: frequency tuning associated with the first antenna element to be performed independently of frequency tuning associated with any other antenna element from among the multiple antenna elements which include the second antenna element; and frequency tuning associated with the second antenna element to be performed independently of frequency tuning associated with any other antenna element from among the multiple antenna elements which include the first antenna element.

18. The SLM antenna system of claim 15, further comprising:

multiple ground connection sub-circuits corresponding to the multiple ground connection points;

a ground terminal electrically coupled to each ground connection point and located on one of a printed circuit board (PCB) and a chassis of the portable device;

wherein at least one of the multiple ground connection sub-circuits provide a path to the ground terminal.

19. The SLM antenna system of claim 15, wherein:

the first antenna element is a Bluetooth (BT) antenna element and the first ground connection point couples the BT antenna element to ground; and the second antenna element is a global positioning system (GPS) antenna element and the second ground connection point couples the GPS antenna element to ground.

20. The SLM antenna system of claim 15, wherein:

the second communication feed is coupled to a capacitive coupler to enable propagation of GPS signals via the GPS antenna element using a capacitive feed technology;

wherein the second ground connection point which corresponds to the second communication feed is connected to the ground plane.

* * * * *